US008905047B2

(12) United States Patent
Heltzel

(10) Patent No.: US 8,905,047 B2
(45) Date of Patent: Dec. 9, 2014

(54) DEVICE AND METHOD FOR SHAPING BODY HAIR

(76) Inventor: Daphne Henriette Lotte Maria Heltzel, Amsterdam (NL)

( * ) Notice: Subject to any disclaimer, the term of this patent is extended or adjusted under 35 U.S.C. 154(b) by 0 days.

(21) Appl. No.: 13/262,602

(22) PCT Filed: Apr. 6, 2010

(86) PCT No.: PCT/NL2010/050175

§ 371 (c)(1),
(2), (4) Date: Sep. 30, 2011

(87) PCT Pub. No.: WO2010/114378

PCT Pub. Date: Oct. 7, 2010

(65) Prior Publication Data

US 2012/0031418 A1 Feb. 9, 2012

(30) Foreign Application Priority Data

Apr. 3, 2009 (NL) ..... 2002713

(51) Int. Cl.

| | |
|---|---|
| ***A45D 7/00*** | (2006.01) |
| ***A45D 24/36*** | (2006.01) |
| ***A45D 27/00*** | (2006.01) |
| ***A45D 27/42*** | (2006.01) |

(52) U.S. Cl.

CPC ..... *A45D 27/00* (2013.01); *A45D 24/36* (2013.01); *A45D 27/42* (2013.01)

USPC ..... 132/200; 132/214

(58) Field of Classification Search

CPC ..... A45D 24/36; A45D 27/38; A45D 27/42; A45D 27/00; A45D 44/22; B26B 19/42; B26B 13/24; B26B 21/42; B26B 21/4018; B26B 21/12; B26B 19/20

USPC ..... 132/214, 200, 210, 212, 213, 215, 216, 132/333, 289, 319, 320, 317, 318, 213.1; 101/3.1; 30/34.2, 537, 233, 200, 30, 30/31, 77, 34.05; D18/15, 16; 119/600, 119/607, 617, 618; 606/116, 117; 33/512, 33/562; 2/466, 73, 400; D28/44, 44.1, D28/44.2, 45–48, 52; 83/442, 175, 176, 83/443, 444, 440.1; 128/830, 835

See application file for complete search history.

(56) References Cited

U.S. PATENT DOCUMENTS

| | | | | |
|---|---|---|---|---|
| 206,870 | A * | 8/1878 | Gamage | 101/31 |
| 1,013,077 | A * | 12/1911 | Sharrow | 132/214 |

(Continued)

FOREIGN PATENT DOCUMENTS

| | | | |
|---|---|---|---|
| AU | 2003101044 | A4 * | 3/2004 |
| DE | 20107167 | U1 | 7/2001 |
| DE | 102006007745 | A1 | 8/2007 |

OTHER PUBLICATIONS

"International Applicartion Serial No. PCT/NL2010/050175, International Search Report mailed Jul. 9, 2010", 5 pgs.

(Continued)

*Primary Examiner* — Vanitha Elgart

(74) *Attorney, Agent, or Firm* — Schwegman Lundberg & Woessner, P.A.

(57) ABSTRACT

The invention relates to a device for shaping pubic hair, comprising a shape-determining member having a circumference for determining the shape of the pubic hair to be realized. The device also comprises a handle for a user to place the shape-determining member on the skin manually. The device comprises a tightening member for pushing in the skin under the device at a distance from the circumference of the shape-determining member, whereby the skin is pushed in deeper underneath the tightening member than underneath the circumference of the shape-determining member. The presence of the tightening member reduces the pressure on the skin at the circumference, owing to which a fold is prevented or is less deep and the slope is less steep. This enables a razor to come closer to the circumference of the template, which makes the contour sharper.

16 Claims, 8 Drawing Sheets

(56) References Cited

U.S. PATENT DOCUMENTS

| | | | | | |
|---|---|---|---|---|---|
| 1,329,437 | A | * | 2/1920 | Smith | 132/214 |
| 1,517,166 | A | * | 11/1924 | Powers | 132/214 |
| 1,537,783 | A | * | 5/1925 | Olson | 132/214 |
| 1,569,452 | A | * | 1/1926 | Bradley | 132/214 |
| 1,585,088 | A | * | 5/1926 | Delmon | 132/214 |
| 1,589,037 | A | * | 6/1926 | Aasen et al. | 132/214 |
| 2,542,450 | A | * | 2/1951 | Altman | 132/213 |
| 2,804,684 | A | * | 9/1957 | Talamonti | 30/34.05 |
| 3,127,675 | A | * | 4/1964 | Kobler | 30/34.2 |
| 3,152,541 | A | * | 10/1964 | Carlsen | 101/125 |
| 3,407,823 | A | * | 10/1968 | Selvaggio | 132/214 |
| 3,557,805 | A | * | 1/1971 | Hamada | 132/216 |
| 3,858,589 | A | * | 1/1975 | Geiger | 132/214 |
| 4,003,309 | A | * | 1/1977 | Munson | 101/406 |
| 4,977,672 | A | * | 12/1990 | Hamilton | 30/233 |
| 5,329,946 | A | * | 7/1994 | Guma | 132/213.1 |
| 5,450,671 | A | * | 9/1995 | Harshman | 30/31 |
| 5,569,237 | A | * | 10/1996 | Beckenstein | 606/1 |
| 5,908,036 | A | * | 6/1999 | Andrews | 132/215 |
| 6,655,389 | B2 | * | 12/2003 | Bertucci | 132/214 |
| 7,198,050 | B2 | * | 4/2007 | Gopou et al. | 132/210 |
| 2002/0088361 | A1 | | 7/2002 | Morgan | |
| 2005/0205105 | A1 | | 9/2005 | Demko | |
| 2006/0070239 | A1 | * | 4/2006 | Ries et al. | 30/34.2 |
| 2009/0065008 | A1 | * | 3/2009 | Clodius-Talmadge | 128/830 |
| 2009/0101155 | A1 | * | 4/2009 | Young et al. | 128/830 |
| 2009/0101161 | A1 | * | 4/2009 | Haghighi | 132/213.1 |
| 2009/0205671 | A1 | * | 8/2009 | Saito | 132/213 |
| 2012/0017843 | A1 | * | 1/2012 | Fernandez | 119/600 |

OTHER PUBLICATIONS

"International Applicartion Serial No. PCT/NL2010/050175, Written Opinion mailed Jul. 9, 2010", 6 pgs.

* cited by examiner

DEVICE AND METHOD FOR SHAPING BODY HAIR

RELATED APPLICATIONS

This application is a U.S. National Stage Filing under 35 U.S.C. 371 from International Application No. PCT/NL2010/050175, filed on Apr. 6, 2010, and published as WO 2010/114378 A1 on Oct. 7, 2010, which claims priority to Netherland Application No. 2002713, filed on Apr. 3, 2009; which applications and publication are incorporated herein by reference in their entirety.

This invention relates to a device and method for shaping body hair.

BACKGROUND OF THE INVENTION

Different methods are known for removing body hair, such as pubic hair. The hair can be shaved off by using an electric shaver or a razor. The hair can also be removed by using depilatory cream. Prewaxed strips can be used as well.

In most places of the body, hair is partially shaved off or removed. An example of this is men's backs. Both men and women often shave the hair on their legs and armpits.

This invention relates to shaping body hair. This does not mean curling the hair of the head, for example with a curling iron, but rather the removal of body hair in a way in which a part of the hair that remains is given a certain shape. A template is sometimes used for shaping the hair in such a way.

Patent Publication DE 10 2006 007 745 A1 describes a shaving template for shaping pubic hair. The shaving template consists of a shape-determining member, a cover and a handle. The shape-determining member has a certain shape that determines the shape of the part of the pubic hair which remains after the surrounding hair has been shaved off. A user can hold the template by the handle and place the template on the skin. Particularly in places of the body where the skin can be pushed in relatively deep, such as the pubic area, the above-mentioned template will also cause a skin fold that gets in the way so that a razor cannot be pressed properly against the template. Even moderate pressure can cause a considerable skin fold around the template. If the hair is shaved off in that case by moving a razor along the circumference of the template, the shaver head of the razor will have to be placed at a bit of a slant with respect to the template. The blades must, after all, make good contact with the skin. In doing so, the side of the shaver head comes in contact with the side of the template, but tilts, owing to which the blades touch the skin at some distance from the template. This distance is not constant and depends on the pressure exerted and skill of the user. The blades therefore do not exactly copy the shape defined by the side of the template. It should be noted that the shape can indeed be copied exactly by using a depilatory cream but this has other disadvantages, such as higher costs, longer treatment time and possible allergic reactions of the skin.

BRIEF SUMMARY OF THE INVENTION

One of the aims of this invention is to be able to copy the shape of a template more accurately by using a razor in the body hair in places where the skin is pliable.

This aim is achieved by a device for shaping body hair, comprising a shape-determining member having a circumference for determining the shape of the body hair to be realized;

a handle enabling a user to place the shape-determining member onto the skin manually, wherein said device contains a tightening member for pushing in the skin underneath the device at a distance from the circumference of the shape-determining member, whereby the skin is pushed in more deeply underneath the tightening member than underneath the circumference of the shape-determining member.

The tightening member reduces the pressure on the skin at the circumference, by which a fold is prevented or less deep, and the slant less steep. This enables a razor to be moved closer to the circumference of the template, thus making the contour sharper.

In an embodiment, the shape-determining member has a surface that gradually ends in the direction of the circumference.

In an embodiment, the shape-determining member has a raised outer edge.

In an embodiment, the raised outer edge is less than 5 mm high. This makes room for the shaver head to tilt with respect to the contact surface and move closely along the circumference.

In an embodiment, an outer end of the handle is at a distance between 50 mm-120 mm from a contact surface determined by the shape-determining member.

In an embodiment, the handle may have a curved, plate form part less than 4 mm thick. This makes it easier to grasp the handle between the fingers, which prevents the template from rotating.

In an embodiment, an outer end of the tightening member is at a distance between 4 mm-10 mm from a contact surface determined by the shape-determining member.

In an embodiment, the distance between the tightening member and the circumference of the shape-determining member is between 5-15 mm. Such a distance proved to produce good results when normal pressure was exerted on the template in the pubic area of a woman.

In an embodiment, the tightening member has a contour practically identical to that of the shape-determining member. It should be noted that, in principle, the contour of the tightening member can have any random shape. This results in approximately the same fold all around the template.

In an embodiment, the shape-determining member comprises a flexible part that makes contact with the skin when in use. Such a template is more in line with the body and better follows unevenness. The member is preferably made of rubber.

In another embodiment, the tightening member is arranged so it can be removed from the shape-determining member. In this way, the user can choose a customized tightening member.

The invention also relates to a method for shaping body hair, comprising:

manually placing a shape-determining member on the skin with some force to determine a shape of body hair to be realized, wherein, with the aid of a tightening member, the skin at a distance from a circumference of said shape-determining member is pushed in more deeply than underneath said circumference of said shape-determining member;

using a razor to shave off the body hair surrounding said shape-determining member.

According to another aspect, a device is provided for shaping body hair, comprising:

a shape-determining member having an essentially rectangular circumference for determining a shape of the body hair to be realized;

a handle for a user to place the shape-determining member onto the skin manually, wherein the shape-determining member has two essentially parallel sides at a distance of less than 25 mm from each other.

This device preferably comprises a contact part at the bottom of the device having several ridges, preferably made of rubber. This provides for a template with a good grip on the skin and a comfortable feeling.

Lastly, the invention relates to a working method for shaping body hair, comprising manually placing the above-mentioned device on the skin with some force;

using a razor to shave off the body hair along one of the sides of the shape-determining member, wherein the device is constantly tilted towards the opposite side.

BRIEF DESCRIPTION OF THE SEVERAL VIEWS OF THE DRAWINGS

Other advantages, characteristics and details of said invention will be clarified further on the basis of a description of several embodiments, with reference to the appended figures in which.

DETAILED DESCRIPTION OF THE INVENTION

Figure 1:
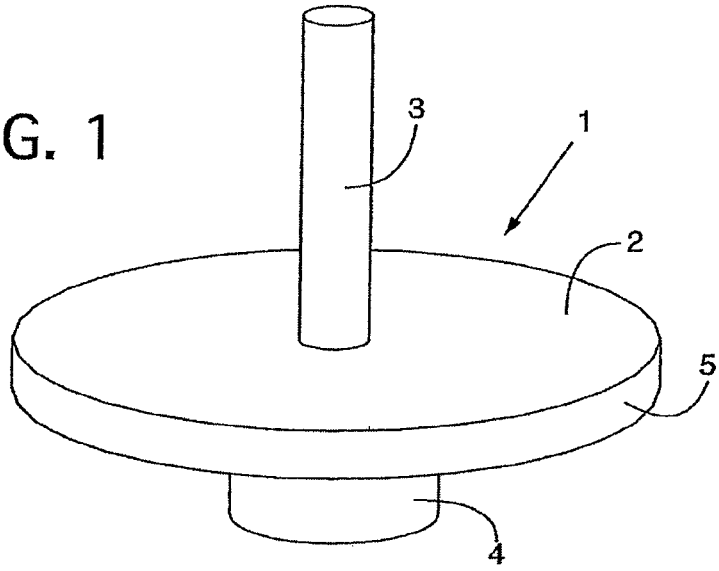
FIG. 1 shows a diagram of a device for shaping body hair according to an embodiment of said invention.
Figure 2:
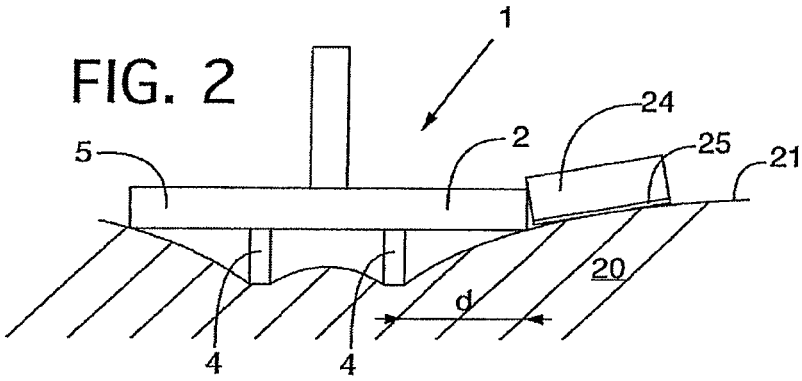
FIG. 2 shows a diagram of the cross-section of the template from FIG. 1 with part of a body and the skin.

FIG. 1 shows a diagram of device 1 for shaping body hair according to an embodiment of the invention. Below, device 1 will be referred to as template 1. The embodiment of FIG. 1 consists of a disc-shaped shape-determining member 2 with a handle 3 attached to it. Attached to the bottom of shape-determining member 2 is a tightening ring 4 which is generally indicated as tightening member 4. Tightening ring 4 is preferably tube-shaped and hollow on the inside. Shape-determining member 2 has a raised side 5 on its circumference. A user can place template 1 on the skin, whereby some pressure is exerted. This will cause template 1 to push in the skin somewhat. FIG. 2 shows a diagram of a cross section of template 1 with part of a body 20 (i.e. tissue) and skin 21. It can be seen clearly that template 1 pushes in the body, which causes several skin folds.

Tightening ring 4 pushes in skin 21 most deeply in the places underneath tension ring 4. This causes a slope (i.e. fold) around tightening ring 4 in skin 21, which curves upwards. In FIG. 2, a distance between tightening ring 4 and the circumference of shape-determining member 2 is indicated by d.

In FIG. 2 a cross-section of shaver head 24 is drawn. Shaver head 24 has a rectangular cross-section wherein razor blades are located on the side where head 24 touches the skin. The pressure exerted by tightening ring 4 reduces the pressure on the skin at the circumference of the template. Because of this, no fold, or at any rate a limited fold will occur. Furthermore, the slope of the skin is less than in the situation without tightening ring 4. Razor 24 can now be moved more in the area of the template, thus also closer to the circumference of side 5. Blades 25 in shaver head 24 will thus be able to follow the contour of side 5 more accurately, which will enable a more accurate copy to be made of the shape of template 1 in the hair.

Depending on the dimensions of tightening member 4, considerable pressure can be exerted, through which template 1 will not easily move. Tightening member 4 can also be closed, but an opening in the tightening member is preferable because it decreases the size of the surface of the tightening member that comes in contact with the skin, thus enabling more pressure to be exerted and decreasing the chance of moving.

Figure 3:
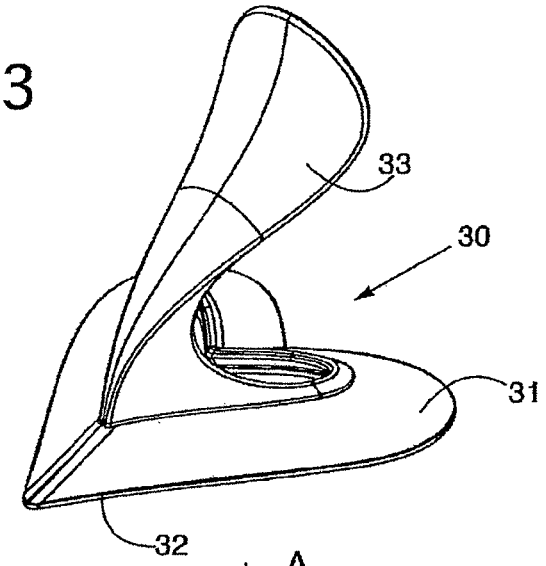
FIG. 3 shows a diagram of another embodiment of said invention.

FIG. 3 shows a diagram of another embodiment of the invention wherein a template 30 has a shape-determining member 31 with a heart-shaped circumference. Shape-determining member 31 has a small, raised edge 32 which is preferably less than 5 mm and more preferably less than 3 mm. A handle 33 is attached to shape-determining member 1. Handle 33 is preferably longer than 5 cm and not longer than 12 cm. More preferably, the handle is not longer than 70 mm. With such a dimension, a user can grip template 30 with one hand, whereby this hand does not get in the way of shaving all round template 30 with a razor in the other hand. Longer dimensions are also conceivable but may be less stable. It is also possible for handle 33 to have a thickening at the top with a support surface on which the user can push.

In an embodiment, the top of shape-determining member 31 is partly open so the user maintains a view of the skin under template 30. If shape-determining member 31 is made of somewhat flexible plastic or rubber, it will become extra flexible through the presence of the opening.

Figure 4:
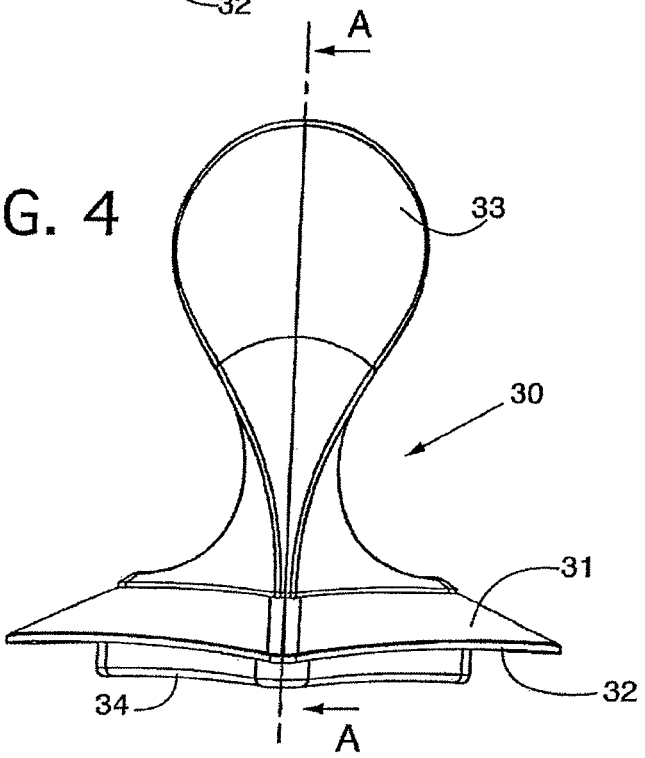
FIG. 4 shows a diagram of the back view of Template 30 from FIG. 3.

FIG. 4 shows a diagram of a side view of template 30 from FIG. 3. Its stylish round handle 33 can be seen clearly. A tightening ring 4 is also visible that is attached to the bottom of shape-determining member 31. One can also see that shape-determining member 31 has a surface that slopes in the direction of the circumference. The advantage of such a surface is that the user may also shave from template 30. In doing so, one can thus place the shaver head on shape-determining member 31 first, after which the shaver head can be moved towards the circumference of shape-determining member 31. Once it makes contact with the skin, the shaver head will shave off the hair. It should be noted that in this case as well, a reduced skin fold at the location of the contour is desirable because the 'twist' the shaver head has to make will be limited, and the ease and comfort of shaving increased.

In the embodiment of FIG. 3, as stated, the shape-determining member has a raised outer side 32. Raised outer side 32 is preferably less than 5 mm high. Its height is preferably more than 2 mm. Shaving tests have proved that such a height is comfortable for the user and that the shaver head is easier to manage in shaving along the contour as well as at a right angle to the contour.

Figure 5:
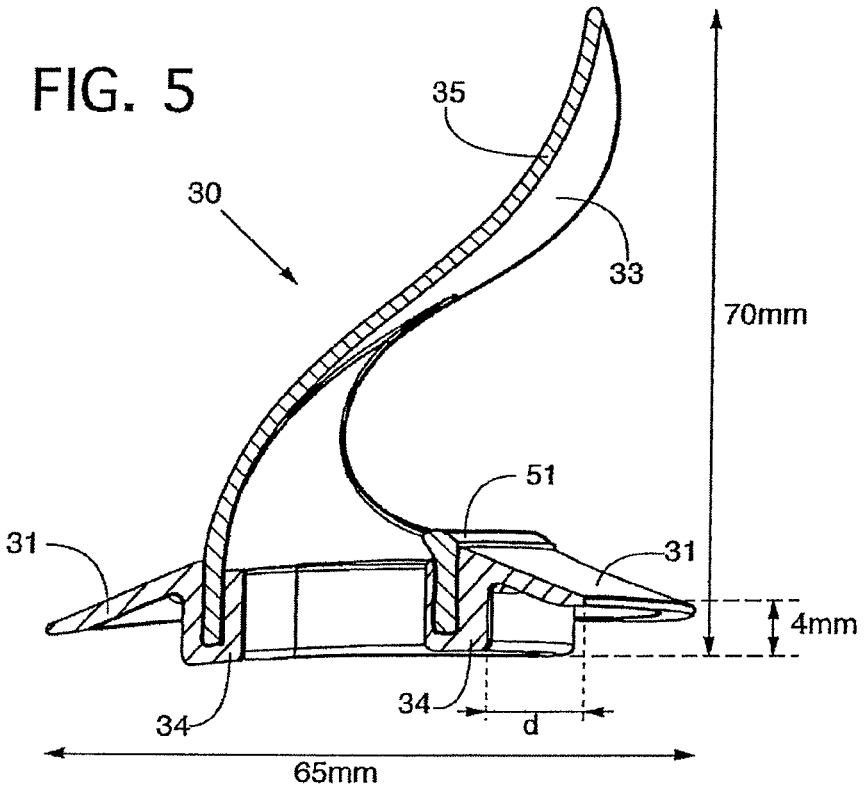
FIG. 5 shows a diagram of a side view of the template from FIG. 4 opened along surface A-A.

FIG. 5 shows a diagram of an opened side view of template 30 from FIG. 4, opened along surface A-A; see FIG. 4. In FIG. 5, an inner edge of the shape-determining member 1 is indicated by reference 51. This inner edge 51 is integrated with handle 33 and is preferably made of hardened plastic. In FIG.

5, different types of hatching indicate that tightening ring 34 is composed of two materials. In this example, the inside of tightening ring 34 is made of plastic and an outer edge of rubber. This rubber edge gives more comfort than plastic. The rubber edge of tightening ring 34 merges into the rubber slanting side of shape-determining member 31.

The distance between the top end of handle 33 and the bottom of tightening ring 34 is preferably between 50 mm-120 mm. In the example from FIG. 5, this distance is 70 mm. It should be noted that other dimensions are possible, depending on the use and/or shape of the template. Said dimensions proved to be very handy in using the template, whereby the hand that fixes the template does not get in the way of shaving off the hairs all round.

In an embodiment, handle 33 comprises a, possibly curved, plate form part 35 which is less than 4 mm thick. This part of handle 33 is easy to grip between the fingers, which decreases the risk of rotation of the template.

The distance between an outer end of tightening member 34 and the contact surface determined by shape-determining member 31 is preferably between 4 mm-10 mm. This means that the skin underneath the tightening member is pushed in 4-10 mm farther than underneath the circumference of the shape-determining member. If the shape-determining member is made of flexible material, this difference will be greater because in that case the shape-determining member will give somewhat if pressure is exerted on it. Said dimensions are typical of the pliability of the female pubic area. The distance between tightening ring 34 and the circumference of shape-determining member 31 can vary and is preferably between 5-15 mm. It should be noted that other dimensions are possible, depending on the place to be depilated, thickness of the underlying fat layer, size of the contour of the template, etcetera.

The tightening member preferably has an essentially identical contour to that of the shape-determining member, whereby the distance from the cut-away to the circumference of the shape-determining member is approximately constant. This will result in approximately the same fold all round the template and the tightened skin, and with that the slope of the skin to be shaved remains constant within certain margins.

FIG. 5 shows clearly that a hollow space if formed between tightening ring 34 and shape-determining member 31. Said skin fold, see also FIG. 2, can be partially included in this space. This hollow space is, however, not necessary. It is conceivable that the bottom of tightening ring 34 will run to the circumference of shape-determining member 31 by way of a slanting slope.

Figure 6:
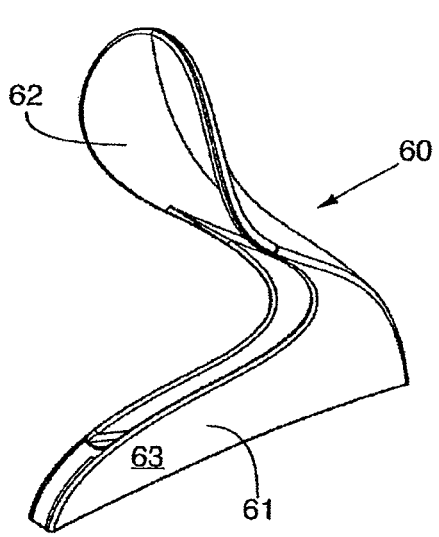
FIG. 6 shows a device for shaping body hair according to another embodiment.

According to a second aspect of the invention, device 60 for shaping body hair, see FIG. 6, comprises a shape-determining member 61 having an essentially rectangular circumference for determining a shape of body hair to be realized. A handle 62 is also present for a user to place shape-determining member 61 on the skin manually.

Figure 7:
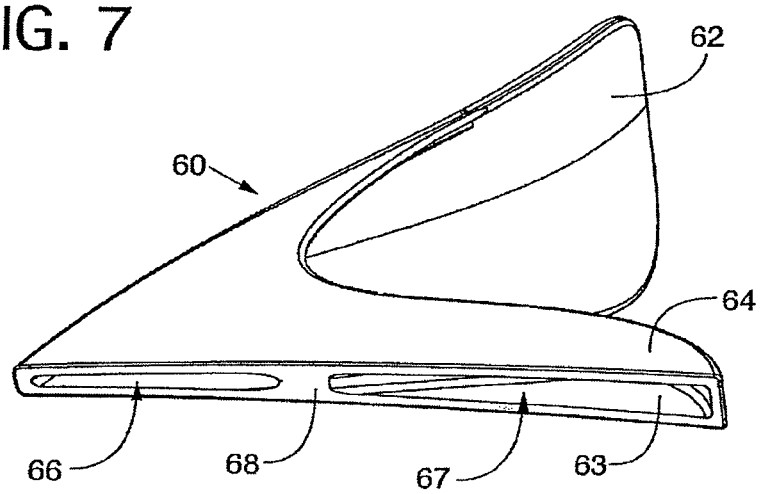
FIG. 7 shows a 3-D perspective of the embodiment of FIG. 6 in which the bottom of the device is visible.

FIG. 7 shows a 3-D perspective of the embodiment of FIG. 6 wherein the bottom of the device is visible. It can be seen that shape-determining member 61 has two essentially parallel sides 63, 64 at a distance of less than 25 mm from each other. The narrow template thus formed is especially suitable for making a thin stripe in pubic hair. Typical values for the distance between the outsides of sides 63, 64 are 10, 15 and 20, depending on the user's wishes. Template 60 comprises one or more openings 66, 67 separated by a partition 68 at the bottom of template 60.

The template from FIGS. 6 and 7 can be used for manually shaving off pubic hair. In doing so, one places template 60 on the skin with some force. This creates a skin fold on each side, but by tilting template 60, one can use a razor to shave off the body hair precisely along one of the sides of the shape-determining member.

Because template 60 is relatively narrow at the bottom, template 60 can easily be tilted, whereby one side, for example 63, is pushed deeper into the skin and the opposite side 64 less deep. Side 63, which goes deepest into the skin, functions in this case as a sort of tightening member that tightens the skin, through which the other side, i.e. 64, is pushed less deep into the skin. So almost no skin fold will occur at side 64. By tilting template 60, whereby the bottom of shape-determining member 61 constantly stays in contact with the skin, one can move the shaver head along one of the sides 63, 64, whereby the skin fold can be kept limited on the shaving side so the distance of the blade to the side is small. This results in a straight line on both sides of the template. It is then still possible to touch up the yet untreated top and bottom of the resulting stripe without the template.

Figure 8:
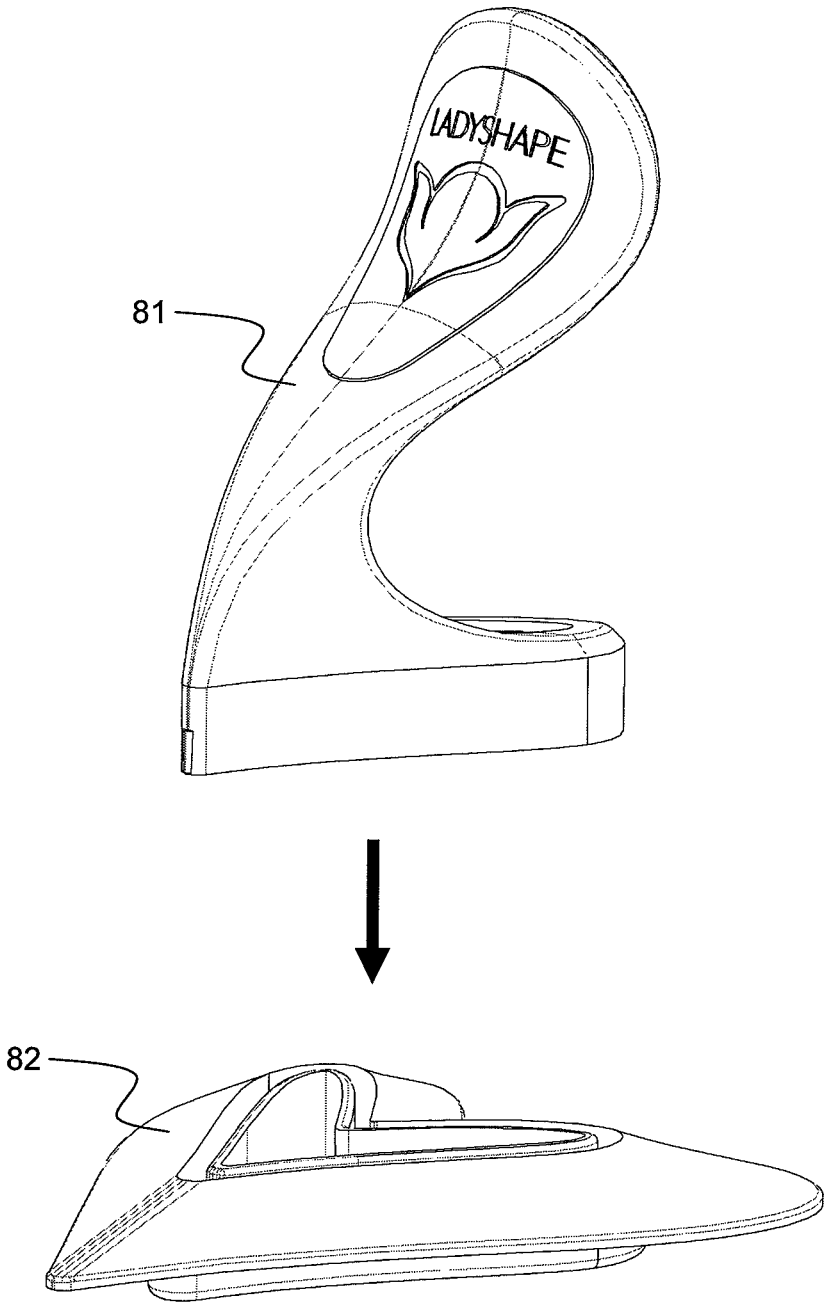
FIG. 8 shows a 3-D perspective of another embodiment.

FIG. 8 shows a 3-D perspective of a device according to another embodiment comprising a handle 81 and basic part 82, wherein handle part 81 can be slid into basic part 82 and fixed. Basic part 82 comprises the shape-determining member and the tightening member as also described in FIGS. 3 and 4. The advantage of composing the device of two separate connectable parts is that the parts can easily be made of two different materials. In an embodiment, handle 81 is made of hard plastic and the basic part of a softer material, such as rubber. This gives rise to a configuration as shown in FIG. 5. Another advantage of using the combination shown in FIG. 8 is that basic part 82, which can be subject to wear and tear, can easily be replaced without having to throw out handle part 81.

Figure 9:
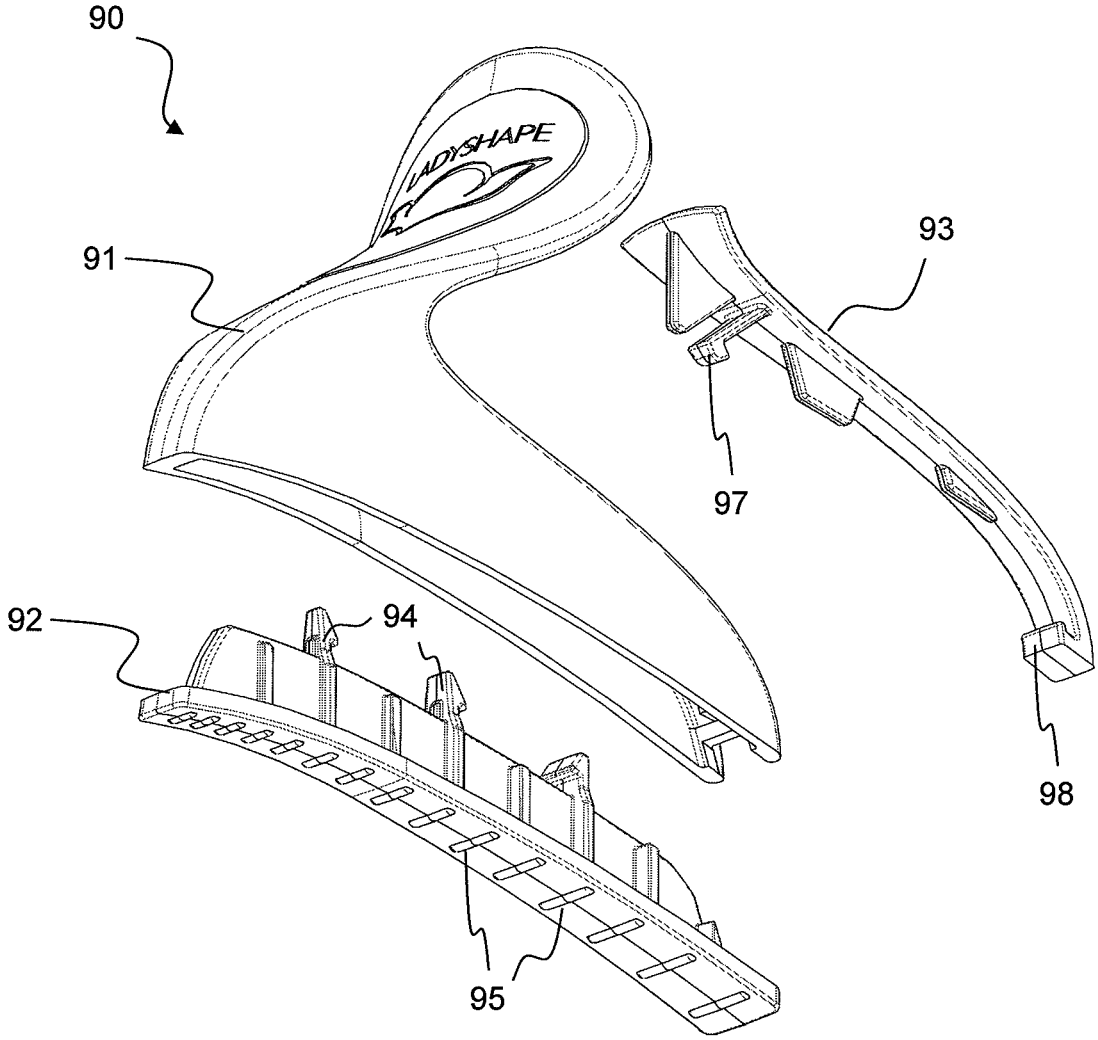
FIG. 9 shows a slanting bottom view of the components of another embodiment.

FIG. 9 shows a slanted bottom view of the components of another embodiment of the device. In this embodiment, device 90 comprises a main part 91 wherein a contact part 92 can be mounted to the bottom and a closing part 93 to the top. Main part 91 is almost identical to the embodiment of FIG. 6, the difference being that the bottom is somewhat curved. This enables the device to make better contact with the skin in places where the body is round, such as at the abdomen and pubic area. The contact part is preferably made of a flexible material such as rubber. Contact part 92 comprises several stops 94 that can fit into cavities (not shown) on the inside of main part 91. Several ridges 95 have been made on the contact surface of contact part 92 which is placed on the skin. These ridges 95 provide for an additional grip on the skin. Closing part 93 comprises several stops 97, 98 so they can be clicked into the top of main part 93. In this way, the top of device 90 is closed tightly. This closing is desirable especially for aesthetic reasons, but it also makes device 90 extra sturdy.

Figure 10:
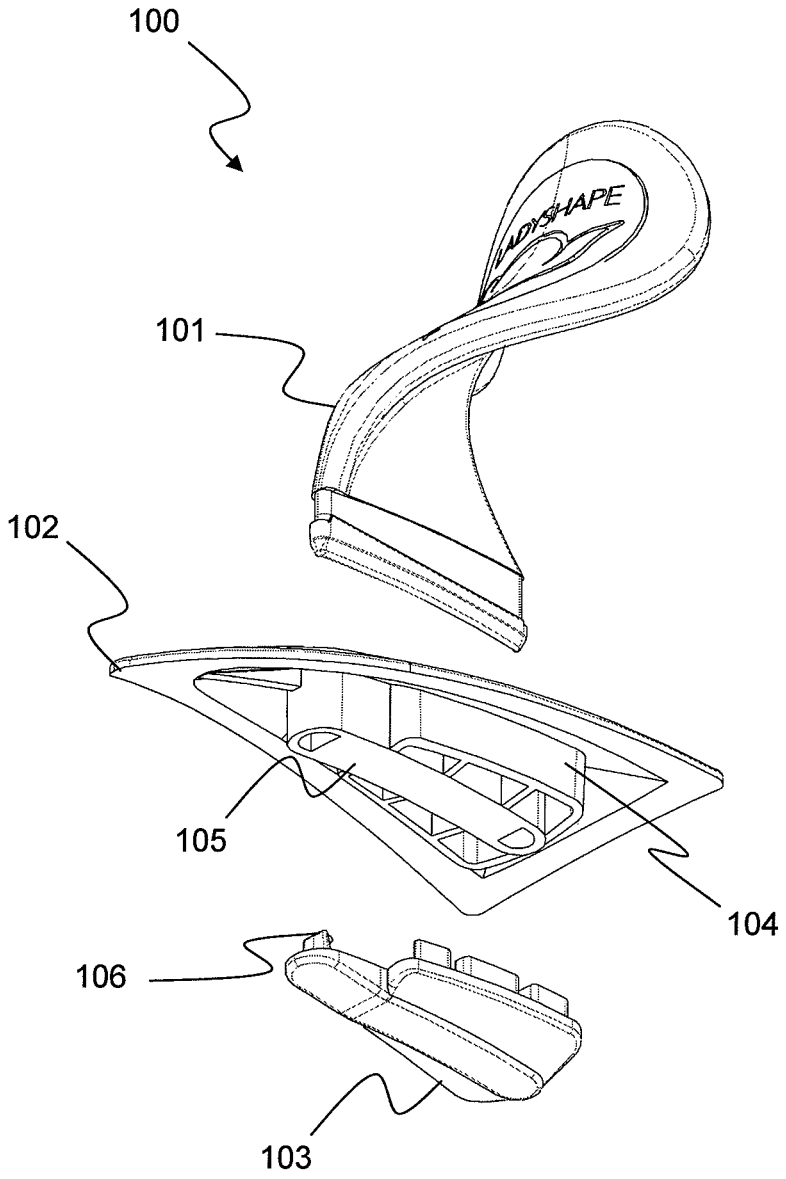
FIG. 10 shows a slanting bottom view of the components of another embodiment.

FIG. 10 shows a slanting bottom view of the components of another embodiment. In this embodiment, device 100 comprises a handle part 101, a basic part 102 and a contact part 103. Handle part 101, as well as contact part 103, can be pushed into basic part 102. The basic part comprises the shape-determining member, i.e. it has the circumference along which the hair can be shaved off. In this case, the shape-determining member has a triangular shape. Several partitions 104 are placed on the bottom of basic part 10 which forms one or more compartments. A main rib 105 is placed as well that has two openings in which stops 106 of contact part 103 can be fixed. Contact part 103 is pushed deepest into the skin during use, and thus functions as a tightening member to tighten the skin underneath the device. The advantage of a removable contact part 103 is that in this embodiment, the extent to which the skin is pushed underneath device 100 can be increased by using a different, in this case higher, contact part 103. In this way, for example people with more abdominal fat can get an appropriate template. It will be clear to the person skilled in the art that such an interchangeable contact part 103 can also be used in the embodiment of FIGS. 1-5. In that case, the shape of the contact part will be adjusted, i.e. heart-shaped instead of triangular.

Figure 11:
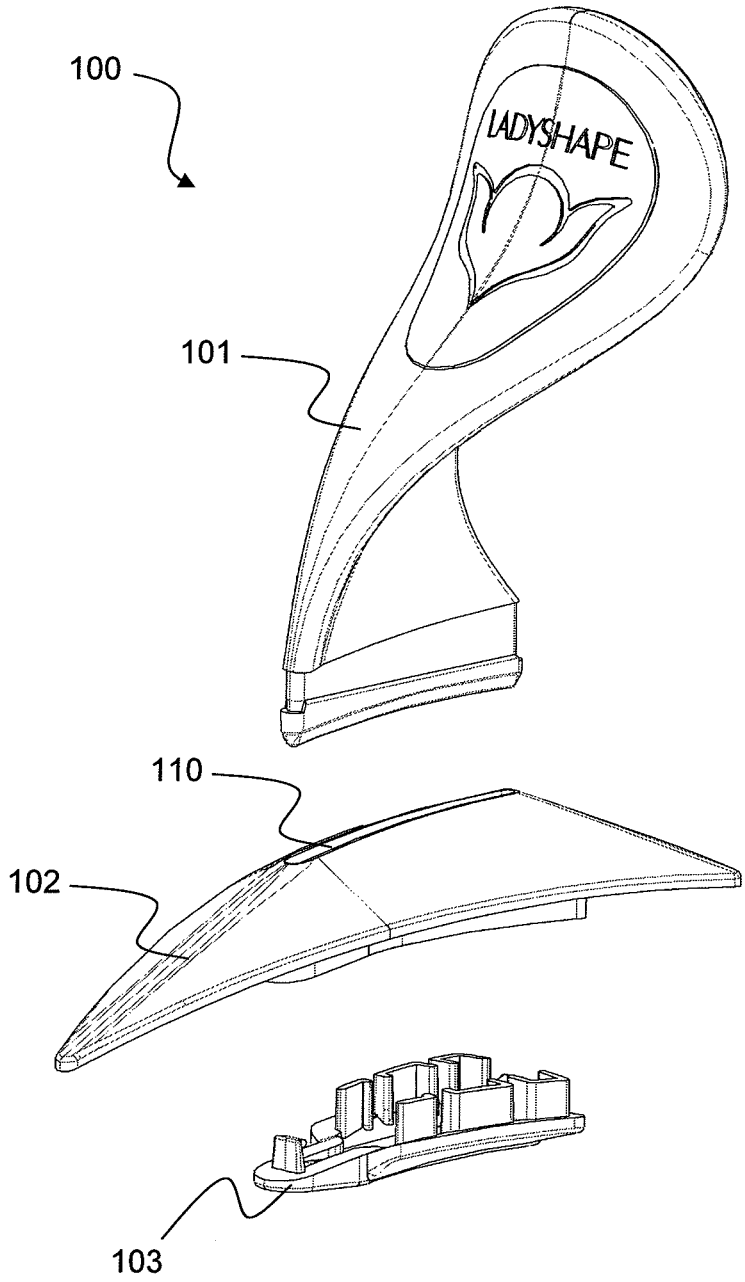
FIG. 11 shows a slanting top view of the components of the embodiment of FIG. 10.

FIG. 11 shows a slanting top view of the components of the embodiment of FIG. 10, in which a slot 110 is visible into which handle part 101 can be slid.

It will be clear to the person skilled in the art that the invention can be used with different shapes. These shapes can be line symmetrical, such as a circle, heart, arrow, triangle, butterfly, star, tear or rectangle. Asymmetrical shapes can be used as well, such as letters and numbers, fantasy shapes and so forth.

It should also be noted that the invention is not limited to shaving off pubic hair. Other hairy body parts, such as legs, buttocks and armpits, can be shaved with the device and working method according to the invention.

In the foregoing, this invention was described on the basis of a few preferred embodiments. Different aspects of different embodiments can be combined, wherein all combinations that can be made by a person skilled in the art on the basis of this document can be read. These preferred embodiments do not limit the scope of protection of this text. The rights applied for are determined in the attached claims.

The invention claimed is:

1. A device for shaping pubic hair, comprising:

a shape-determining member having a circumference for determining the shape of the pubic hair to be realized; and a handle arranged at a first side of said shape-determining member, for manual placement by the user of said shape-determining member on the skin during shaving, wherein the shape-determining member is provided with a tightening member arranged at a second side, opposite said first side, of said shape-determining member, wherein said tightening member protrudes at a first distance inwardly from said circumference, wherein the tightening member protrudes from a contact surface of said shape-determining member, whereby the skin is pressed deeper under the tightening member during use than under said circumference of said shape-determining member, wherein the tightening member lies within the circumference of the shape-determining member, and wherein a tightening effect to the skin is provided for reducing pressure of the skin at said circumference of the shape-determining member.

2. The device according to claim 1, wherein the shape-determining member comprises a surface that slopes towards the circumference.

3. The device according to claim 1, wherein the shape-determining member has a raised outer side.

4. The device according to claim 3, wherein the raised outer side is less than 5 mm high.

5. The device according to claim 1, wherein an outer end of the handle is at a third distance between 50 mm-120 mm from the tightening member.

6. The device according to claim 1, wherein the handle comprises a plate form part having a thickness of less than 4 mm.

7. The device according to claim 1, wherein the tightening member protrudes over a distance of between 4 mm-10 mm.

8. The device according to claim 1, wherein the tightening member has an essentially identical contour to that of the shape-determining member.

9. The device according to claim 1, wherein the shape-determining member comprises a flexible part that, in use, makes contact with the skin.

10. The device according to claim 1, wherein the first distance between the tightening member and the circumference of the shape-determining member is between 5-15 mm.

11. The device according to claim 1, wherein the tightening member is arranged so it can be removed from the shape-determining member.

12. A method for shaping pubic hair, comprising:

manually, with some force, placing a shape-determining member on the skin to determine a shape of the pubic hair to be realized, wherein the shape-determining member is provided with a tightening member, wherein said tightening member protrudes at a first distance inwardly from a circumference, wherein the tightening member protrudes from an imaginary plane defined by a contact surface of said shape-determining member, wherein the tightening member is used to push in the skin at a distance from the shape-determining member deeper than the skin underneath the circumference of the shape-determining member to tighten the skin underneath the device, wherein a tightening effect to the skin is provided for following the contour of the shape-determining member; and thereby providing a sharper contour of the shape-determining member, and using a razor to shave off the pubic hair surrounding the shape-determining member.

13. A device for shaping pubic hair, comprising:

a shape-determining member having a circumference for determining a shape of the pubic hair to be realized;

wherein the shape-determining member has an essentially rectangular circumference for determining a shape of the pubic hair to be realized;

a handle for a user to place the shape-determining member on the skin manually, wherein the handle is arranged at a first side of said shape-determining member, for manual placement by the user of said shape-determining member on the skin during shaving, and wherein the rectangular circumference of the shape-determining member comprises two essentially parallel sides at a distance of less than 25 mm from each other, and provides a tightening effect to the skin when one side of the said parallel sides is pushed into the skin, thereby providing a sharper contour of the shape-determining member.

14. A device according to claim 13, wherein the device comprises a contact part at a second side, opposite to the first side, of the shape-determining member of the device, comprising several ridges and is made of flexible plastic or rubber.

15. A method for shaping pubic hair, comprising:

manually placing a device on the skin with some force, wherein the device comprises a shape-determining member having a circumference for determining the shape of the hair to be realized;

wherein the shape-determining member has an essentially rectangular circumference for determining a shape of the pubic hair to be realized;

a handle for a user to place the shape-determining member on the skin manually, wherein the handle is arranged at a first side of said shape-determining member, for manual placement by the user of said shape-determining member on the skin during shaving, wherein the rectangular circumference of said shape-determining member comprises two essentially parallel sides at a distance of less than 25 mm from each other;

the method further comprising using a razor to shave off the pubic hair along one of the essentially parallel sides of the circumference of the shape-determining member, wherein during said using of the razor, the device is tilted towards a first one of the sides of the parallel sides so that the first one of the sides is pushed deeper into the skin than an opposite side of the parallel sides in order to tighten the skin underneath the device so as to provide a tightening effect to the skin and therefore provide a sharper contour of the shape-determining member.

16. The device according to claim 1, wherein the shape-determining member is made of flexible plastic or rubber.

* * * * *

UNITED STATES PATENT AND TRADEMARK OFFICE

CERTIFICATE OF CORRECTION

PATENT NO. : 8,905,047 B2
APPLICATION NO. : 13/262602
DATED : December 9, 2014
INVENTOR(S) : Daphne Henriette Lotte Maria Heltzel It is certified that error appears in the above-identified patent and that said Letters Patent is hereby corrected as shown below:

On the title page, in column 2, in References Cited under "Other Publications", line 1, delete "Applicartion" and insert --Application--, therefor On title page 2, in column 2, in References Cited under "Other Publications", line 1, delete "Applicartion" and insert --Application--, therefor Signed and Sealed this
Twenty-first Day of April, 2015

Michelle K. Lee

Michelle K. Lee
*Director of the United States Patent and Trademark Office*